US012460325B2

(12) United States Patent
Atil et al.

(10) Patent No.: US 12,460,325 B2
(45) Date of Patent: Nov. 4, 2025

(54) WOVEN FURRY FABRIC AND A METHOD OF PRODUCTION THEREOF

(71) Applicant: Sanko Tekstil Isletmeleri San. Ve Tic. A.S., Inegol-Bursa (AR)

(72) Inventors: Ezgi Atil, Inegol-Bursa (AR); Erdogan Baris Özden, Inegol-Bursa (AR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 135 days.

(21) Appl. No.: 16/830,168

(22) Filed: Mar. 25, 2020

(65) Prior Publication Data

US 2020/0308731 A1 Oct. 1, 2020

(30) Foreign Application Priority Data

Mar. 26, 2019 (EP) ..... 19165322

(51) Int. Cl.

| | |
|---|---|
| ***D03D 13/00*** | (2006.01) |
| ***D02G 3/02*** | (2006.01) |
| ***D02G 3/44*** | (2006.01) |
| ***D03D 1/00*** | (2006.01) |
| ***D03D 15/54*** | (2021.01) |

(52) U.S. Cl.

CPC ..... *D03D 13/004* (2013.01); *D02G 3/02* (2013.01); *D02G 3/44* (2013.01); *D03D 15/54* (2021.01); *D03D 1/00* (2013.01)

(58) Field of Classification Search

None

See application file for complete search history.

(56) References Cited

U.S. PATENT DOCUMENTS 6,799,581 B2 * 10/2004 Cave ..... A45D 8/34 132/273
7,188,642 B2 * 3/2007 James ..... G02B 6/4459 139/384 R
7,300,692 B2 * 11/2007 Hirota ..... D03D 27/06 428/92

(Continued)

FOREIGN PATENT DOCUMENTS

EP 3205755 A1 * 8/2017 ..... D01D 5/30
JP 2002061070 A * 2/2002

(Continued)

OTHER PUBLICATIONS

Choudhury, Asim Kumar Roy. "Indigo Dye: Various Ecofriendly Finishes 14.3.8 Denim Biowash." Indigo Dye—an Overview | Science Direct Topics, Principles of Textile Finishing, 2017, https://doi.org/10.1016/B978-0-08-100646-7.00014-X. (Year: 2017).*

(Continued)

*Primary Examiner* — Grace Huang

(57) ABSTRACT

A furry fabric includes a woven fabric having a plurality of warp and/or weft yarns extending over a number of weft or warp yarns and/or below a number of weft or warp yarns to provide over and/or under-portions having a length comprised between 8 and 3000, preferably between 25-3000. The over and under portions are at least in part cut in a garment including the furry fabric. Alternatively, the warp or weft over portions and/or the warp or weft under portions of said first yarns are not cut or broken.

27 Claims, 14 Drawing Sheets

(56) References Cited

U.S. PATENT DOCUMENTS

| | | | | |
|---|---|---|---|---|
| 7,571,746 | B2 * | 8/2009 | Hay | D21F 1/0045 139/383 R |
| 9,365,958 | B2 * | 6/2016 | Yenici | D03D 15/56 |
| 9,885,130 | B2 * | 2/2018 | Yenici | D03D 17/00 |
| 10,051,905 | B2 * | 8/2018 | Benefiel | G06V 10/50 |
| 10,104,917 | B2 * | 10/2018 | Liao | D06M 15/693 |
| 10,167,579 | B2 * | 1/2019 | Kilickan | D03D 27/02 |
| 10,221,506 | B2 * | 3/2019 | Yenici | D03D 15/56 |
| 10,378,127 | B2 * | 8/2019 | Aydelette | D03D 15/573 |
| 11,021,814 | B2 * | 6/2021 | Kilickan | D03D 15/33 |
| 11,208,761 | B2 * | 12/2021 | St. Onge-Simpson | B23K 26/0006 |
| 11,241,055 | B2 * | 2/2022 | Love | D06P 5/2005 |
| 11,572,641 | B2 * | 2/2023 | Yenici | D03D 15/567 |
| 12,024,800 | B2 * | 7/2024 | Kalfa Kilickan | D03D 1/00 |
| 2012/0278981 | A1 * | 11/2012 | Ialenti | A41B 11/02 2/24 |
| 2013/0115841 | A1 * | 5/2013 | Ronner | D03D 15/258 28/165 |
| 2016/0083877 | A1 * | 3/2016 | Kalfa Kilickan | B32B 7/12 156/60 |
| 2017/0233904 | A1 * | 8/2017 | Weening | D03D 13/00 139/420 R |
| 2019/0151494 | A1 * | 5/2019 | Selva Sarzo | A61F 13/0273 |

FOREIGN PATENT DOCUMENTS

| | | | |
|---|---|---|---|
| JP | 2008031583 | A * | 2/2008 |
| WO | 2011104022 | A1 | 9/2011 |

OTHER PUBLICATIONS

"Sodium Bisulfate: Common Names, Compound Name and More." Jones Hamilton. Jul. 4, 2022. http://web.archive.org/web/20220704234804/https://www.jones-hamilton.com/sodium-bisulfate-compound-names/ (Year: 2022).*

European Search Report issued by the EPO on Sep. 30, 2019 for corresponding EP application No. 19165322.9.

International Search Report issued by the EPO on Jun. 30, 2020 for corresponding PCT application No. PCT/EP2020/058467.

* cited by examiner

WOVEN FURRY FABRIC AND A METHOD OF PRODUCTION THEREOF

This application claims priority to and the benefit of European Application No. 19165322.9 filed on 26 Mar. 2019, the content of which is incorporated herein by reference in its entirety.

TECHNICAL FIELD

The technical field of the present invention relates to a woven fabric that imitates natural fur, i.e. has a furry appearance, and to a method of producing such fabric.

In particular, the present invention relates to a woven fabric that is used to produce clothing articles and garments. A preferred type of fabric of the invention is a denim fabric or a fabric having a denim look; in a preferred embodiment at least part of the yarns are indigo dyed. Denim is referred to in the following description, but the invention is not limited to the production of denim fabrics only.

The invention comprises also a method of production of a woven fabric having a furry appearance as above mentioned.

BACKGROUND

Fabrics that imitate animal furs have been known for a long time. For example, GB3015, filed on 5 Feb. 1914 in the name of Hammer, discloses a fabric that is woven double in the loom and that is divided to provide a fur imitation fabric. Another fur imitation fabric is disclosed in U.S. Pat. No. 5,609,935; this document teaches to manufacture a pile fabric out of different polyester fibers. The two types of polyester fibers protruding from the base fabric have different resistance to alkali so that the less alkali-resistant fibers can be shortened by an alkali agent to better imitate a natural fur.

A fabric having a furry appearance can also be created using specialized knitting or weaving machines which are not common for denim production. Another option is to use a highly specialized manual manufacturing process which is expensive and needs long production times and cannot easily be adapted to industrial production in high volumes. There is therefore the need of providing an improved fabric that imitates fur, i.e. has a furry appearance, and method of producing the same in an economic way that is simple to implement on existing looms and weaving machines.

An aim of the invention is to solve the above problems and to provide a woven fabric imitating fur that is created using common machines such as dobby machines or jacquard machines using particularly designed weaving reports.

Denim is a popular fabric that is produced by weaving weft and warp yarns in a twill design. Weaves that are employed for denim manufacture vary depending on the area of application. Fine denim fabrics are normally composed of plain weaves. However, denim fabrics that are conventionally used under slightly rougher conditions are made using a twill weave, namely a weave characterized by a diagonal pattern.

A further aim of the invention is thus to provide a woven fabric, including indigo dyed fabrics, having a furry appearance and suitable to give a general appearance of fur, i.e. a furry appearance while providing at the same time a look that reminds the user of indigo denim. In other words, it is an aim of the invention to provide a fabric, and eventually a garment, that has a fur look and that is obtained from a woven fabric produced with commonly available machines by an inexpensive method.

This and other aims are achieved by a woven fabric according to claim 1 and by a method according to claim 10. The dependent claims delineate preferred and/or especially advantageous aspects. The invention also relates to a garment according to claim 16.

SUMMARY OF THE INVENTION

An embodiment of the invention provides a woven fabric having a fur-like look, the woven fabric having warp yarns and weft yarns, said fabric having a front side and a back side, said warp and weft yarns being woven together in a weaving pattern, the weaving pattern comprising a base and at least one of warp or weft over portions and/or at least one of warp or weft under portions, whereby at least one of the warp or weft yarns are extending over a number of weft or warp yarns and below a number of weft or warp yarns to provide said warp or weft over portions in said front side and/or warp or weft under portions in said back side and wherein the warp over portions or the warp under portions are long, i.e. they have a length comprised between 8 and 3000 yarns. Similarly, the weft over portions or the weft under portions are long, i.e. they have a length comprised between 25 and 3000 yarns.

An advantage of this embodiment is that it makes possible to have very long over portions on the warp side or on the weft side, namely on the front side of the fabric, such over portion being suitable for creating a furry appearance to the final product without requiring any special machine or process.

The invention further comprises a method of preparing a fabric according to claim 10. The method includes the steps of weaving warp yarns or weft yarns following a pattern comprising a base and warp or weft over portions and/or warp or weft under portions, whereby said warp and weft yarns are woven together in a weaving pattern, the weaving pattern comprising a structural base of the fabric and at least one of warp or weft over portions and/or at least one of warp or weft under portions, whereby at least one of the warp or weft yarns are extending over a number of weft or warp yarns and below a number of weft or warp yarns to provide said warp or weft over portions in said front side and/or warp or weft under portions in said back side and wherein the warp over portions or the warp under portions have a length comprised between 8 and 3000 yarns, preferably 8-300 yarns and the weft over portions or the weft under portions have a length comprised between 25 and 3000 yarns, preferably 25-300 yarns. Preferably, the warp and/or weft over or under portions have a length of 30 to 450 yarns, more preferably of 40 or 45 to 400 yarns. According to another embodiment, the fabric is provided with warp over portions or warp under portions (or both) having a length of 30 to 450 yarns and the weft yarns have weft under portions with a length of less than 25 yarns. Thus, in some embodiments, the warp over portions have a length comprised between 40 and 3000 yarns, i.e., the warp over portions have a length that extends past 40-3000 weft yarns in some embodiments. In some embodiments, the warp over portions have a length comprised between 30 and 3000 yarns, i.e., the warp over portions have a length that extends past 30-3000 weft yarns in some embodiments.

According to an embodiment, the fabric has warp and/or weft over portions of the above stated length provided at least on the front side of the fabric, possibly only on the front side of the fabric; a garment obtained from the fabric of this embodiment will be provided with the long over portions at least (possibly only) on the front side of the garment, i.e. the visible side of the garment. The back of the fabric is the side intended to be in contact with the wearer's body. According to an embodiment at least the warp yarns provided with the said long over portions (on the front side) are dyed, more preferably ring dyed; a suitable dye is black, indigo or another indigoid dye. The fabrics may also be a white fabric ready for dyeing or ecru fabric or any suitable color.

The fabric of the invention has alternated first and second warp yarns or first and second weft yarns or both. The first yarns, i.e. the first warp and/or weft yarns, have long over portions or under portions. The first yarns may have long over portions and long under portions; the long over portions and under portions may be provided in a same first yarn. These yarns provide the part of the fabric that imitates a fur, i.e. that gives a furry look to the garment. The second yarns have short over and under portions, e.g. portions floating, i.e. extending, over 1 to 3 or 4 yarns. The second yarns provide a base structure of the fabric. The base structure of the fabric is thus comprising a weaving of warps and wefts supporting the long over portions and under portions. It should be noticed that the fabric of the invention may have long over portions only warpwise; in such an embodiment the weft yarns are all second weft yarns, i.e. they concur to form a fabric base structure with the second warp yarns.

With the wording "alternated" it is meant that the first yarns are woven to be adjacent to one or more second yarns. Preferably the first and second yarns are alternated with a ratio "number of first yarns/number of second yarns" in the range 3/1 to 1/3, preferably 2/1 to 1/1. These arrangements are shown in the examples here below discussed.

According to an aspect of the invention, the length of the over portions in a same first yarn may be different. In this embodiment a yarn over portion may be e.g. long 20; the successive over portion may be long e.g. 15 and the following over portion may be long e.g. 30. The same may apply to the under portions of one yarn. Such feature may improve the natural look of the fabric. In an embodiment a feature that may provide a furry look to the fabric is the fact that the fabric may be woven with a twill arrangement. With "twill arrangement" it is meant that at least the second weft yarn floats across the second warp yarns in a progression of interlacings to the right or left, forming a pattern of distinct diagonal lines (a so-called wale).

Another feature that improves the fur look of the fabric is the fact that the over and under portions may have a discontinuity. According to another aspect of the invention, at least part of the long over portions or at least part of the long under portions or at least part of both in the first yarns have a discontinuity. In other words, the long portions of the first yarns are made of two portions that extend from the fabric base structure. The discontinuity is typically obtained by cutting the over/under portions. A suitable cutting means is a laser device for use in textiles.

In another embodiment, the over or under portions are broken or cut in any way which will be discussed more in detail in the following description. In another embodiment, the over or under portions are whole, i.e. they are not cut. In an embodiment, the warp long over portions are located on the front side of the fabric and are cut in two parts projecting from the fabric body; in this embodiment the back side of the fabric may have no long weft under portions or may have long weft under portions underportions that are whole, i.e. they are not cut.

The cutting process can be performed using any known cutting machine, even including the use of knife or may be obtained by the use of any type of suitable chemical treatment. Also laser cutting can be performed alternatively. It is possible to perform the cutting process on the fabric during the finishing process or it is possible to be perform the cutting process on the garment or apparel obtained from the fabric. According to one embodiment, the cutting or breaking of the under or over portions is carried out before or during the washing treatment of the garment. Furthermore, chemical treatments for the fabric can be used for cutting and/or breaking the fibres. Possible chemical treatments are described in more detail in the following description.

It is an advantage of the present invention that an imitation fur fabric (and garment) may be obtained by using an inexpensive woven fabric having the claimed ranges of long over portions (and under portions). When the over portions in the finished fabric are cut, they curl in a fur-like look that may be further enhanced by additional treatments.

BRIEF DESCRIPTION OF THE DRAWINGS

Further aspects and advantages of the present invention will be discussed more in detail with reference to the enclosed drawings, given by way of non-limiting example, wherein.

DETAILED DESCRIPTION

Exemplary embodiments of the invention will now be described with reference to the enclosed drawings without intent to limit application and uses.

The invention will now be described with initial reference to FIG. 1 wherein a woven fabric 10 is depicted. The woven fabric 10 is obtained by crossing warp yarns w1, w2 and weft yarns 2, 2BS, 2FS, in a weaving pattern whereby the warp yarns w2 are extending over and below a number of weft yarns 2, 2BS, 2FS, to provide, with respect to the weft yarns 2, 2BS, 2FS, correspondent over portions and, eventually, under portions. Warp yarns w1 are interlaced with weft yarns 2, 2BS, 2FS, to provide a structural base portion of the fabric 10.

Figure 1:
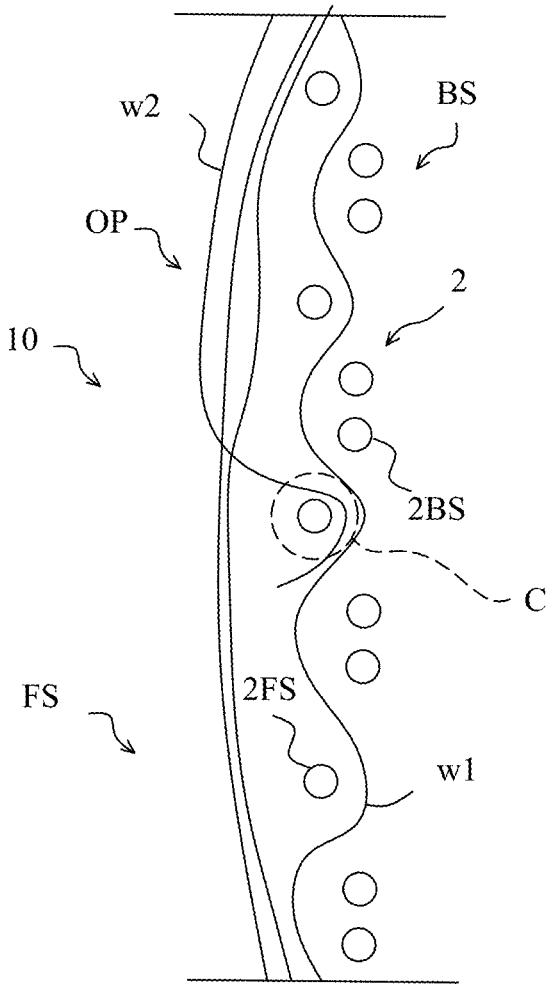
FIG. 1 is a section view of a possible embodiment of the fabric according to the invention after weaving showing the over portions on the warp direction.

In FIG. 1 under portions refer to portions being formed when warp yarns pass under a number of weft yarns 2, 2BS, 2FS, at the back side BS of the fabric, and over portions refer to portions of warp yarn w1, w2 that are formed when the warp yarns w1, w2 pass along the front side FS of the fabric and define connection portions. For example, the length of an over portion (or of an under portion) is measured by referring to the numbers of weft yarns 2, 2BS, 2FS, that is passed by the warp between two changes.

In many applications of the invention, the length of the over portions can be for the warp direction from 4 mm to 1400 mm, preferably 4-140 mm, most preferably 18 mm to 70 mm; for the weft direction from 8 mm to 1100 mm, preferably 8-110 mm, most preferably 12 mm to 50 mm.

Figure 2:
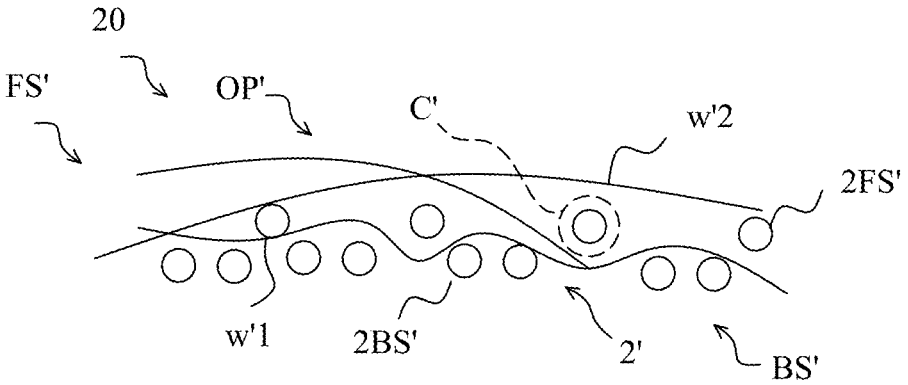
FIG. 2 is a section view of the fabric showing the over portions on the weft direction.

FIG. 2 is a section view of a fabric according to another embodiment of the invention, globally indicated with the numerical reference 20, showing over portions on the weft direction.

The woven fabric 20 is obtained by crossing weft yarns w'1, w'2 and warp yarns 2', BS', 2FS', in a weaving pattern whereby the weft yarns w'2 are extending over and below a number of warp yarns 2', BS', 2FS', to provide, with respect to the warp yarns 2', BS', 2FS' correspondent over portions and, eventually, under portions. Weft yarns w'1 are interlaced with warp yarns 2', BS', 2FS', to provide a structural base portion of the fabric 20.

In FIG. 2 under portions refer to portions being formed when weft yarns pass under a number of warp yarns 2', BS', 2FS', at the back side BS' of fabric 20, and over portions refer to portions of weft yarns w'2 that are formed when the weft yarns w'2 pass along the front side FS' of fabric 20 and define connection portions. For example, the length of an over portion (or of an under portion) is measured by referring to the numbers of warp yarns 2', BS', 2FS', that is passed by the weft between two changes.

In preferred embodiments of the invention, the warp over portions OP or the warp under portions have a length comprised between 8 and 3000 and the weft over portions OP' or the weft under portions have a length comprised between 25 and 3000.

As it is known, weave patterns can be conventionally displayed using weave symbols. In the present description, an integer number expressing a length such as the above mentioned numbers 8, 25 and 3000 indicates the count number of warp (or weft) yarns that are passed over (or under) by an over portion (or an under portion) of a weft (or warp) yarn, respectively.

In another embodiment, the warp or weft over portions (or under portions) have a length comprised between 30 to 450 yarns, preferably of 40 or 45 to 400 yarns more preferably in the range of 40 and 100 yarns.

The length in millimeters of the over portions can be for the warp direction from 4 mm to 1400 mm preferably 4 to 140 mm, more preferably, 18 mm to 70 mm; for the weft direction the length may be in the range of from 8 mm to 1100 mm, preferably 8 to 110 mm, more preferably 12 mm to 50 mm.

In an embodiment of the invention, for example, the fabric may be realized by using one warp yarn w2 for the mentioned over portions and the following warp yarn w1 is used for a regular weave pattern such as 1/1, 2/1 (such as the one depicted in FIGS. 1 and 2) or 3/1 and so on.

Alternatively, for example, two warp yarns w2 can be used for the over portions and a following warp w1 for a regular weave pattern to hold together the whole fabric construction therefore defining a base for the fabric. In general, some warp yarns w2 are used to create the over portions and some warp yarns w1 are used in a regular weave pattern to hold together the fabric. The same is valid for fabric 20 of FIG. 2 in which warp yarns have been substituted with weft yarns and vice versa.

In this types of fabric, such as fabric 20, therefore, some weft yarns w'2 are used to create the over portions and some weft yarns w'1 are used in a regular weave pattern to hold together the fabric forming a base for the fabric.

The fabric disclosed may be a standard rigid (non stretch) fabric or, in a variant embodiment, it may be a stretch fabric or a bi-stretch fabric whereby at least some of the warp and/or weft or both warp and weft yarns are elastic.

Apart from indigo yarn dye or overdye, the fabric disclosed may be black or white (ready for dyeing), ecru, or of other colors, or of any overdyed color with different dyestuffs such as sulphur dyes, reactive dyes, pigment, direct dyestuff. Also for the weft direction yarns may be black, overdye or weft yarn dyed indigo.

Yarns of any fiber, natural or man-made can be used for the present invention. In particular, considering warp/weft yarns that are used for the base of the fabric, they may be from Ne 0.5 to Ne 400, most preferably Ne 7 to Ne 50. The warp or weft yarns used for the over portions may be from Ne 0.5 to Ne 400, preferably 0.5 to 40, more preferably Ne 2 to Ne 15 or Ne 4 to Ne 15. Warp numbers may be different than each other or can be equal. Yarns may be one ply or multiply. Yarns can be any natural or man made fibres. Splittable yarns are not used in the present invention for the first warp or weft yarns, i.e. for the yarns provided with the long over or under portions; preferably splittable yarns are not used at all. Suitable yarns, particularly for the first yarns, that provide the free-hanging portions of yarns and contribute to the visual effect, are metallized yarns. A yarn for the present invention may also be obtained by cutting a plurality of stripes from a film, e.g. glittered stripes obtained from a glittered film. One yarn of this kind is e.g. known in the art and is commercially available from Lurex.

Some other examples of constructions may provide for warp direction over portions of length from 4 mm to 1400 mm, preferably 4 to 140 mm, most preferably from 18 mm to 70 mm. For the weft direction the over portions may be long from 8 mm to 1100 mm, preferably 8-110 mm, most preferably from 12 mm to 50 mm.

Figure 3:
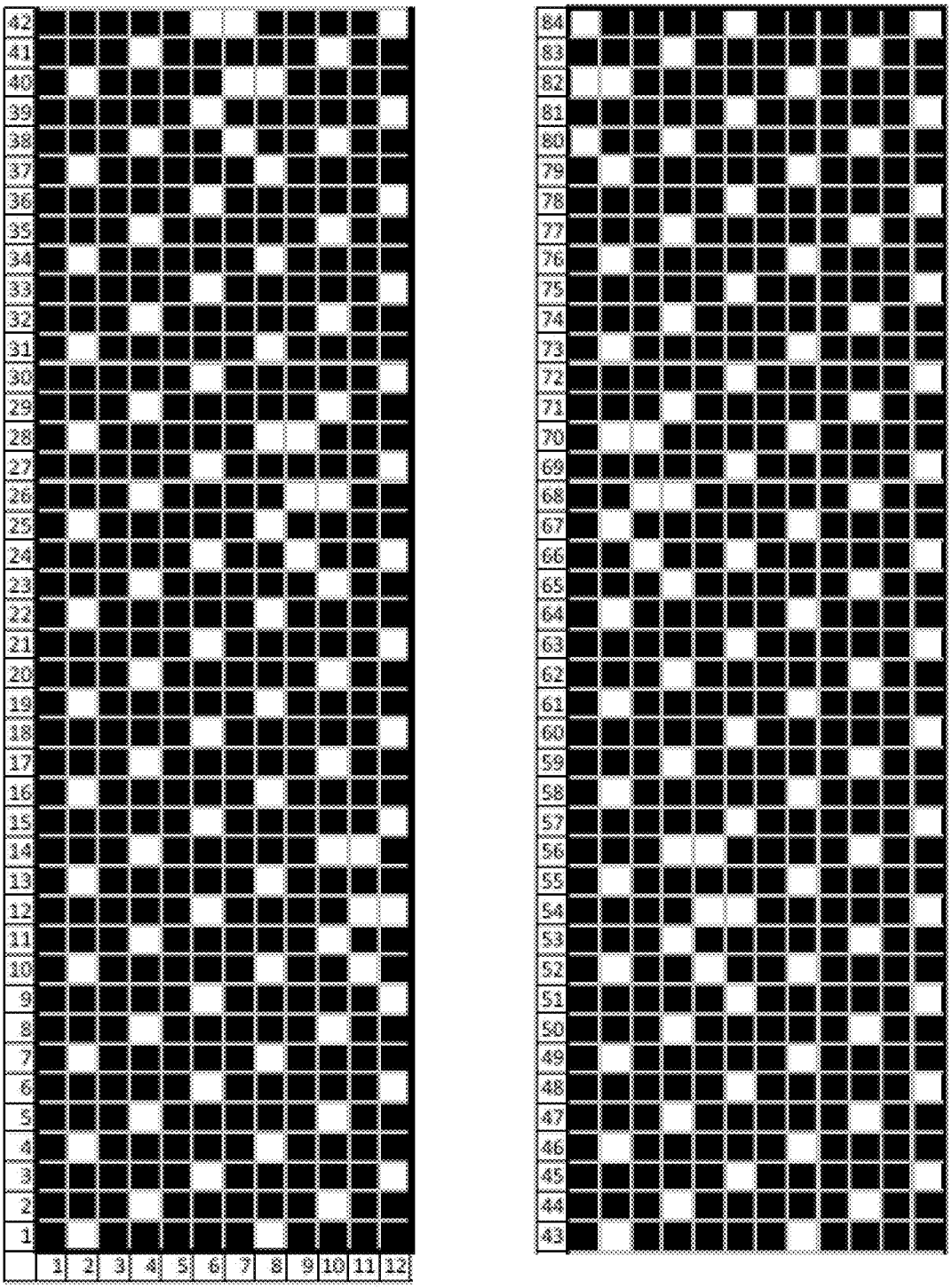
FIG. 3 is a weaving report, or scheme, of an embodiment of the fabric of the invention.

FIG. 3 is a weaving report, or scheme, of an embodiment of the fabric of the invention. FIG. 3 weaving report is a 12×84 construction representing the warp direction single front face fur design. For clarity such construction has been represented in two semi-reports, the construction of FIG. 3 being provided with a warp having a long (length is 79 weft yarns) over portion and two short over portions (length 1) and three short under portions (length 1) for odd-numbered warps and 28 over portions (of length 2) and 28 under portions (of length 1) for even numbered warps. The scheme is 79/1/1/1/1/1 (bottom to top) for odd-numbered warps and 2/1 for even numbered warps.

In the scheme of FIG. 3 the weft has two long under portions (length 5) and two short over portions (length 1)

except for picks 10, 24, 38, 52, 66 and 80 where the weft has one under portion of length 5, two under portions of length 2 and three over portions of length 1 and therefore a scheme of 5/1/2/1/1/2/1.

Also for picks 12, 26, 40, 54, 68 and 82, the weft has one under portion of length 5, one under portion of length 4, one over portion of length 2 and one over portion of length 1, the scheme being 4/2/5/1 and for picks 14, 28, 42, 56, 70 and 84, the weft has one under portion of length 5, one under portion of length 4 one over portion of length 2 and one over portion of length 1 with a scheme of 5/2/4/1. For the construction of FIG. 3, as an example:

Warp 1: 15/1 Ne (for the base).

Warp 2: 4/1 Ne (for the over portions).

Weft: 15/1 Ne.

Warp density on the loom: 33.

Weft density on the loom: 22.

Reed number: 70/4/182 (5096 warp ends, reed length 1820 mm).

Fur length, i.e. the length of the warp long over portion (length 79 yarns), of this example is 36 mm with weaving report of FIG. 3.

Figure 4:
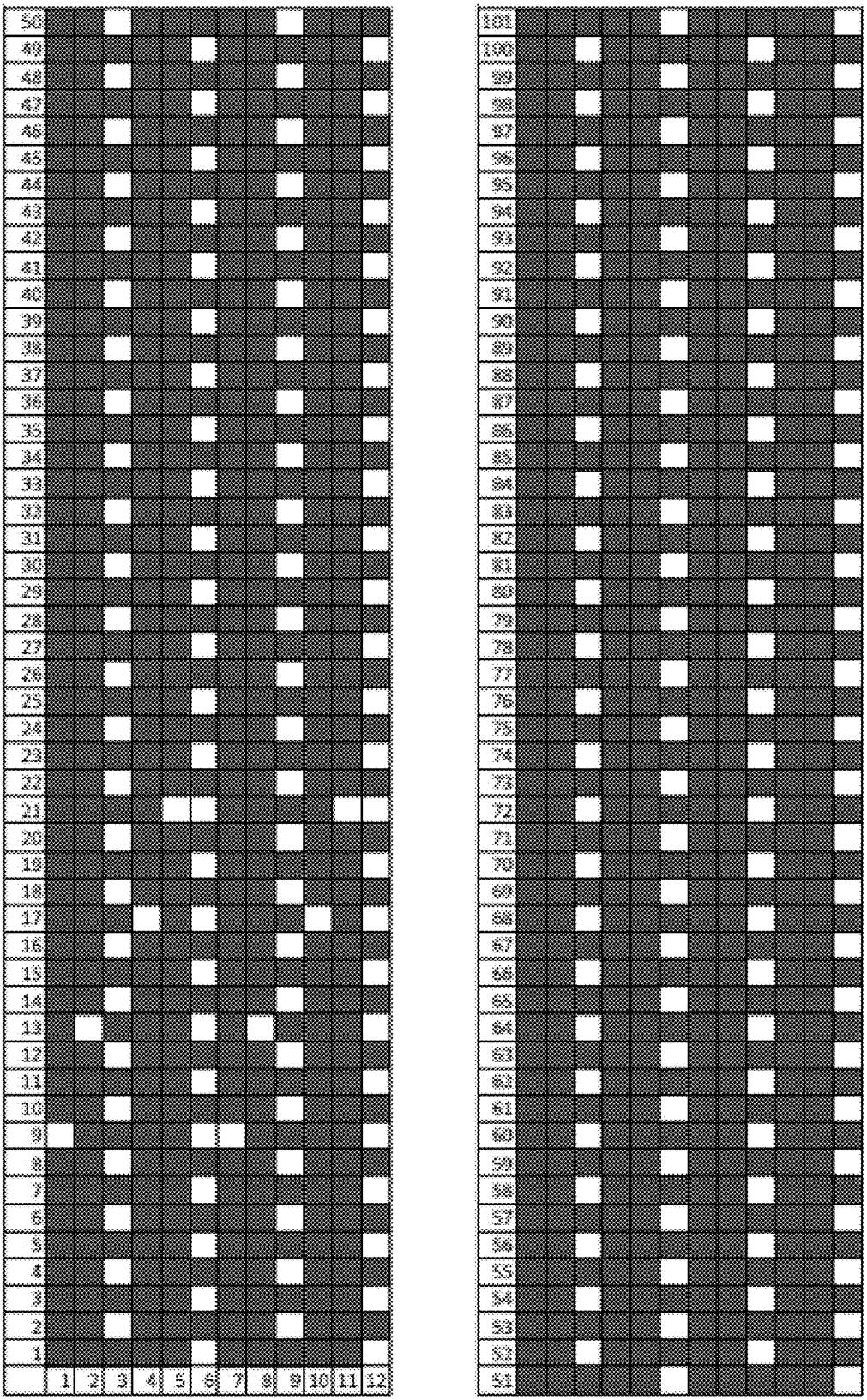
FIG. 4 is a weaving report of an alternative embodiment of the fabric of the invention.

FIG. 4 is a weaving report of an alternative embodiment of the fabric of the invention again representing the warp direction single front face fur design. FIG. 4 weaving report is a 12×101 construction that for reasons of clarity has been represented in two semi-reports. The construction of FIG. 4 is provided with a warp having a long (length 100) over portion and one short under portion (length 1) for warps numbered 1, 2, 4, 5, 7, 8, 10, and 11 with a scheme 100/1. For warps numbered 3, 6, 9 and 12, the construction of FIG. 4 is provided with warps having 51 over portions of length 1 and 50 under portions of length 1 with a scheme of 1/1.

In the scheme of FIG. 4, the weft has two long under portions (length 5) and two short over portions (length 1) with a scheme of 5/1/5/1 except for picks 9 and 23 which has two long under portions (of length 4) and two short over portions (length 2) with a scheme 4/2/4/2. Also for picks 13 and 17, the weft has two long under portions (of length 3), two short under portions (length 1) and four short over portions of length 1 with a scheme of 3/1//1/1/3/1/1/1.

Figure 5:
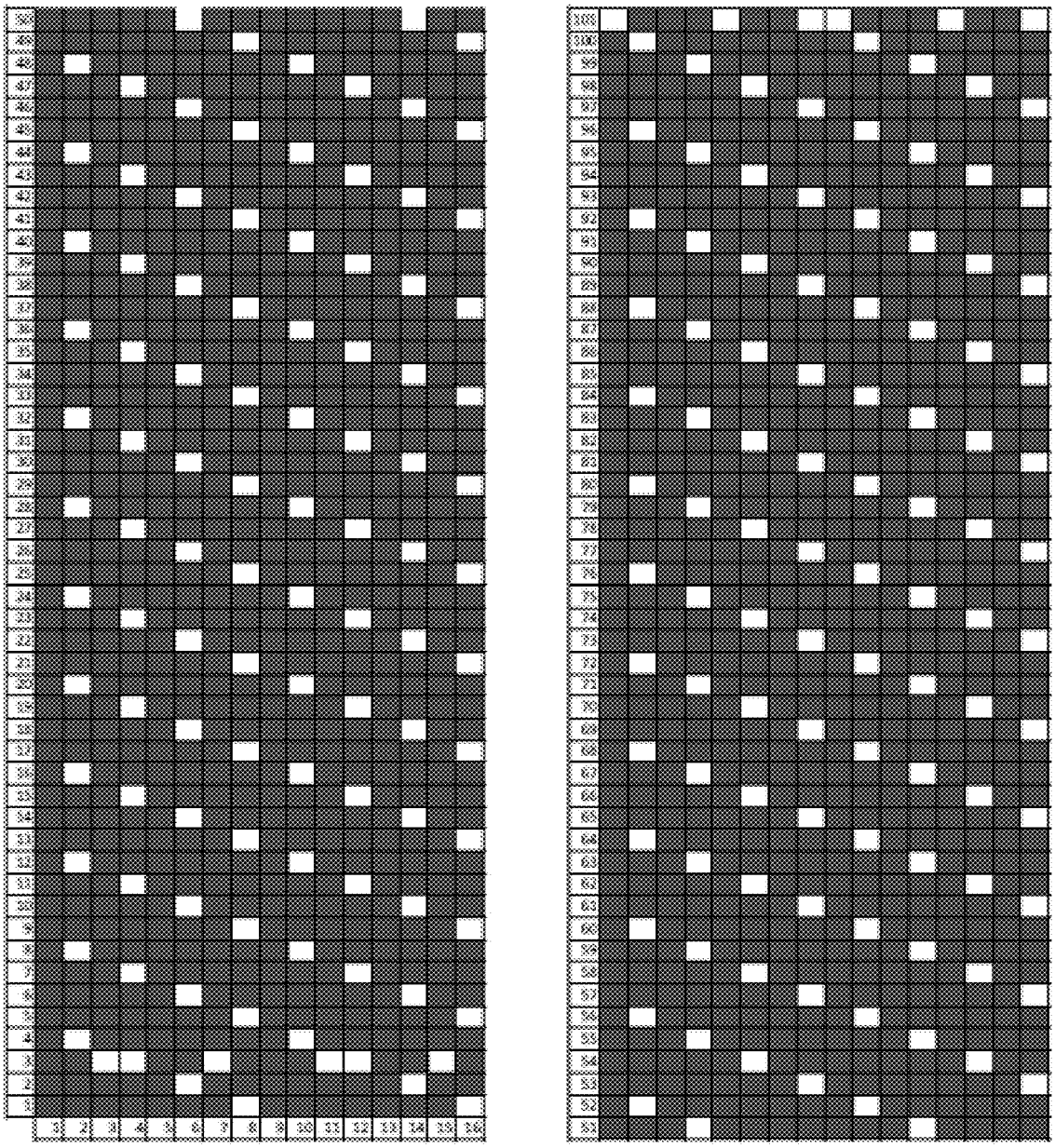
FIG. 5 is a weaving report of still another embodiment of the fabric of the invention.

FIG. 5 is a weaving report of still another embodiment of the fabric of the invention; again representing the warp direction single front face fur design. FIG. 5 weaving report is a 16×101 construction that for reasons of clarity has been represented in two semi-reports. The construction of FIG. 5 is provided with a warp having a long (length 100) over portion and one short under portion (length 1) for odd-numbered warps 1, 3, 5, 7, 9, 11, 13 and 15 with a scheme 100/1. For even-numbered warps 2, 4, 6, 8, 10, 12, 14 and 16, the construction of FIG. 5 is provided with warps having 25 over portions of length 3 and 35 under portions of length 1 with a scheme of 3/1.

The construction of FIG. 5 follows basically a twill scheme, with two weft under portions of length 7 and two weft over portions of length 1 with a scheme of 7/1/7/1 with the exception of pick 3 and 101 having each two under portions of length 3, two under portions of length 2, two over portions of length 2 and two over portions of length 1, with a scheme of 1/3/1/2/2/3/1/2/1.

Figure 6:
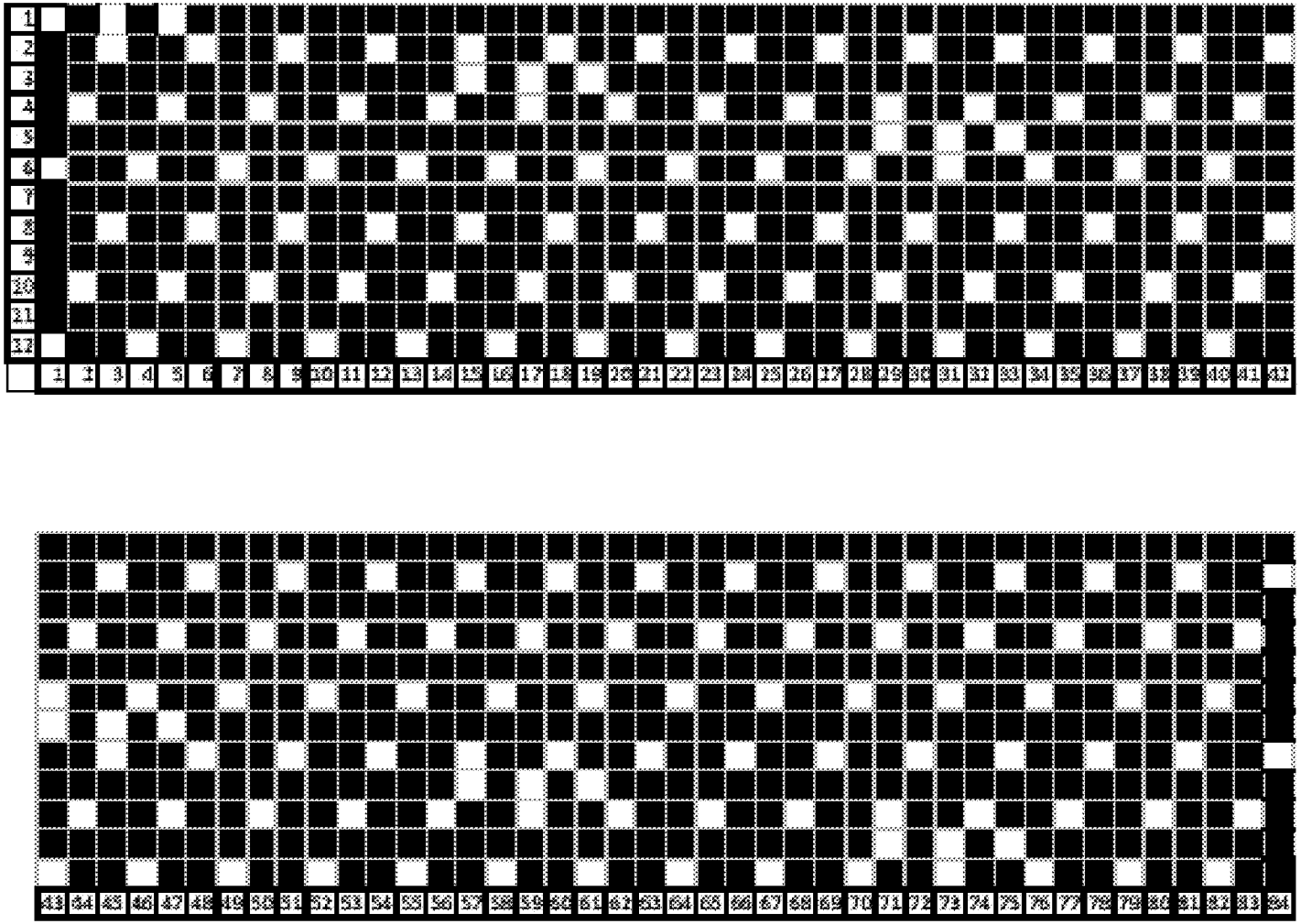
FIG. 6 is a weaving report in the weft direction of another embodiment of the fabric of the invention.

FIG. 6 is a weaving report in the weft direction of another embodiment of the fabric of the invention representing weft direction on the single back side denim fur design. FIG. 6 weaving report is a 12×84 construction that for reasons of clarity has been represented in two semi-reports. The construction of FIG. 6 is provided with a weft having a long (length 79) under portion, two short under portions (length 1) and two short over portion (length 1) for odd-numbered picks 1, 3, 5, 7, 9, and 11 with a scheme 79/1/1/1/1.

For even-numbered picks 2, 4, 6, 8, 10 and 12, the construction of FIG. 6 is provided with wefts having 28 under portions of length 2 and 28 over portions of length 1 with a scheme of 2/1. The construction of FIG. 6 follows basically a twill scheme and is provided with a warp having two long (length 5) over portions and two short under portions (length 1) with a scheme of 5/1/5/1.

As exceptions, warps 3, 17, 31, 45, 59 and 73 show warps provided with two long over portions (respectively of length 4 and 5) and two short under portions (respectively of length 2 and 1) with a scheme of 4/1/5/2. Warps 5, 19, 33, 47, 61 and 75 are provided with two short over portions of length 2, a long over portion of length 5 and three under portions of length 1 with a scheme of 2/1/5/1/2/1b. Warps 15, 29, 43, 57 and 71 are provided with two long over portions (respectively of length 4 and 5) and two short under portions (respectively of length 2 and 1) with a scheme of 5/1/4/2.

Figure 7:
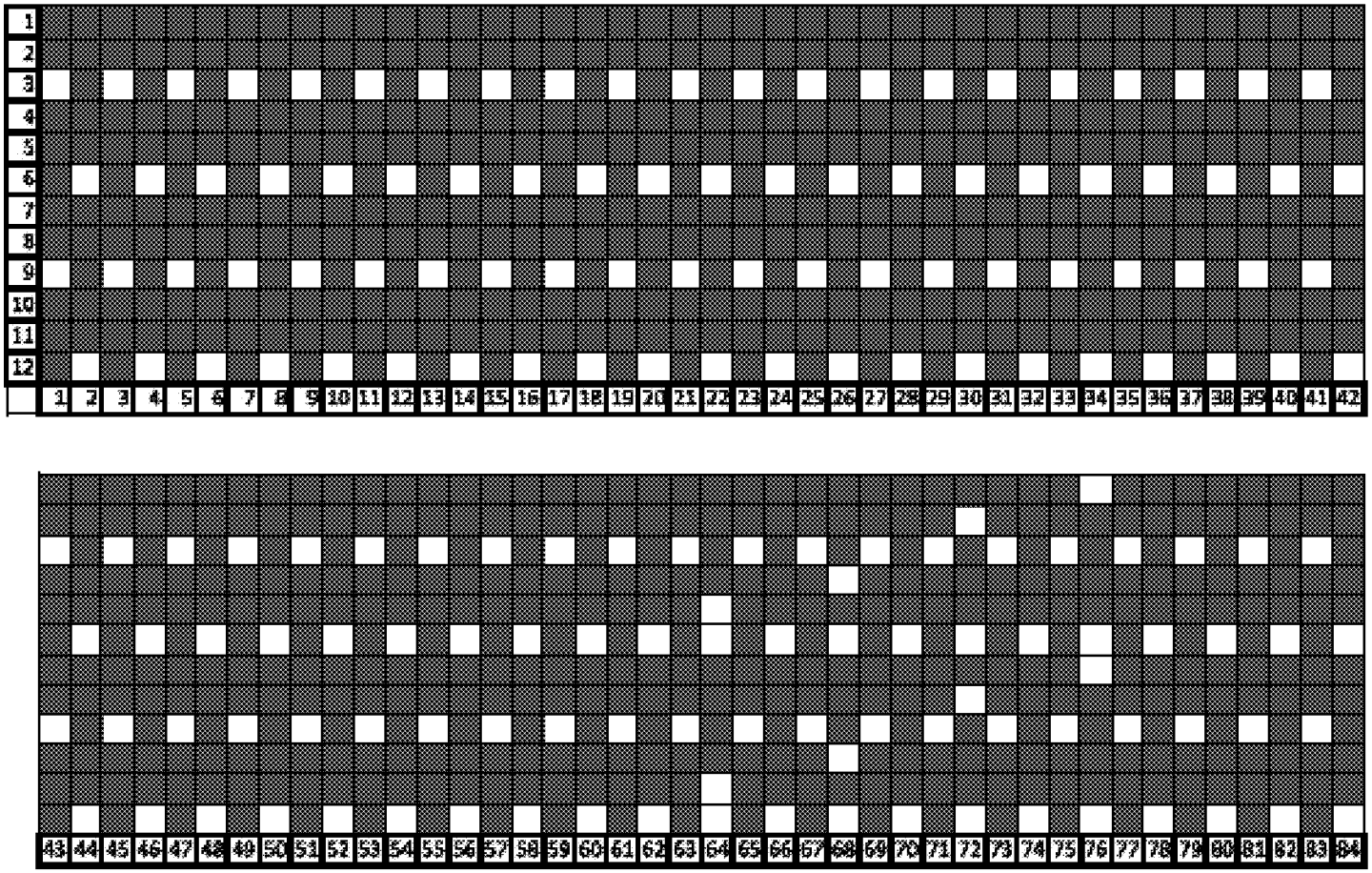
FIG. 7 is a further weaving report in the weft direction of another embodiment of the fabric of the invention.

FIG. 7 is a further weaving report in the weft direction of another embodiment of the fabric of the invention representing weft direction on the single back side denim fur design. FIG. 7 weaving report is a 12×84 construction that for reasons of clarity has been represented in two semi-reports.

The construction of FIG. 7 is provided with a weft having a long (length 83) under portion and one short over portion (length 1) for picks 1, 2, 4, 5, 7, 8, 10 and 11 with a scheme 83/1. For picks 3, 6, 9, 12 the construction of FIG. 7 is provided with wefts having 42 over portions of length 1 and 42 under portions of length 1 with a scheme of 1/1.

The construction of FIG. 7 follows basically a twill scheme and is provided with a warp having two long (length 5) over portions and two short under portions (length 1) with a scheme of 5/1/5/1. As exceptions, warps 64 and 76 show warps provided with two long over portions (length 4) and two short under portions (length 2) with a scheme of 4/2/4/2 and warps 68 and 72 show with two long over portions (length 3), two short over portions (length 1) and four short under portions (length 1) with a scheme of 3/1/1/1/3/1/1/1.

Figure 8:
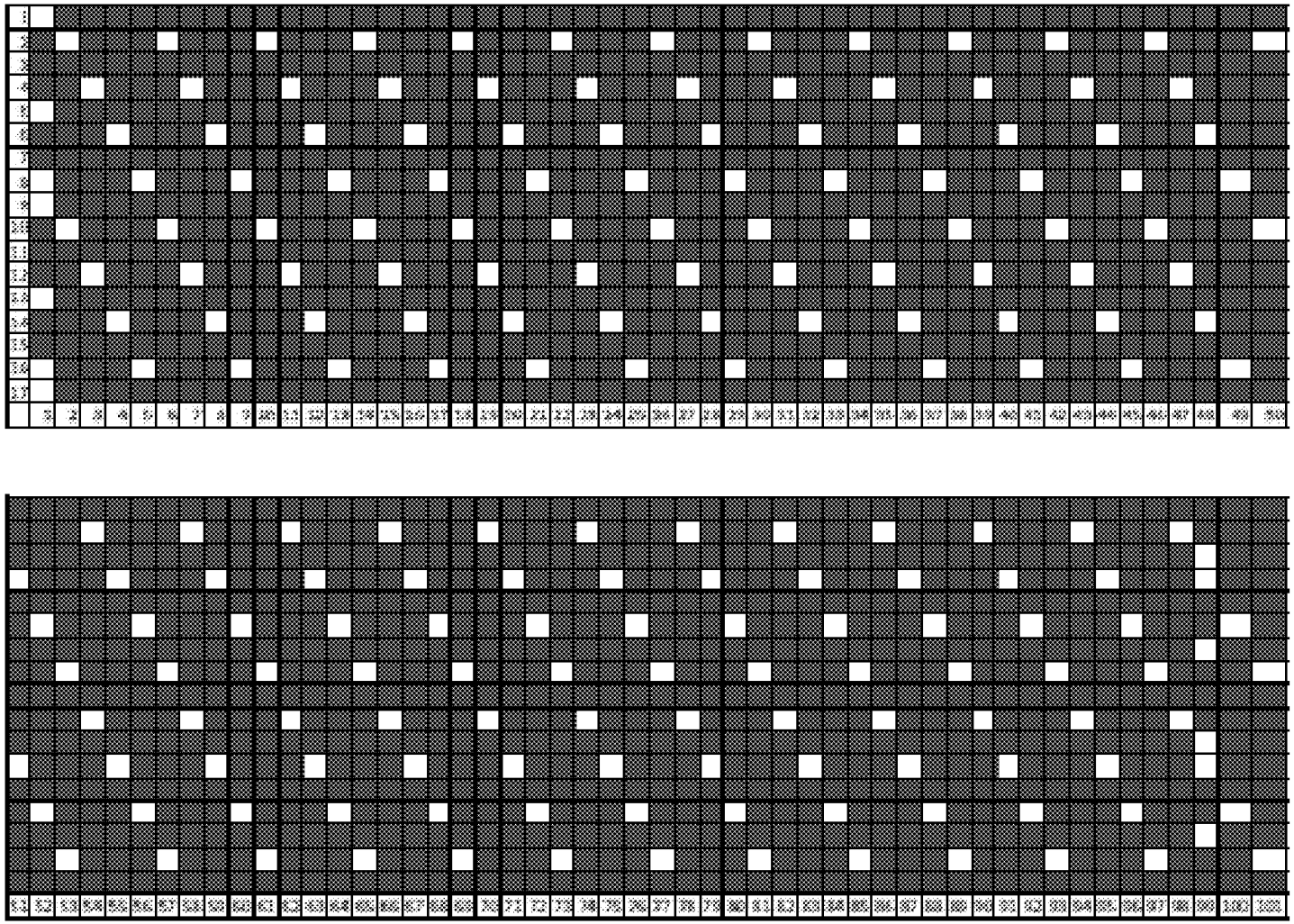
FIG. 8 is still another weaving report in the weft direction of a further embodiment of the fabric of the invention.

FIG. 8 weaving report is a 17×101 construction that for reasons of clarity has been represented in two semi-reports representing a weft direction single back denim fur design. The construction of FIG. 8 is provided with a weft having a long (length 100) under portion and one short over portion (length 1) for odd-numbered picks 3, 5, 7, 9, 11, 13, 15, and 17 with a scheme 100/1. For even-numbered picks 2, 4, 6, 8, 10, 12, 14 and 16 the construction of FIG. 8 is provided with wefts having 25 under portions of length 3 and 25 over portions of length 1 with a scheme of 3/1.

The construction of FIG. 8 follows basically a twill scheme and shows warps provided with two long over portions (respectively of length 7 and 8) and two short under portions (length 2 and 1) with a scheme of 7/1/8/1, with the exception of warps 1 which show a scheme of 3/2/1/3/2/2/1/3 and 99 which show a scheme of 4/1/2/2/3/1/2/2.

Figure 9:
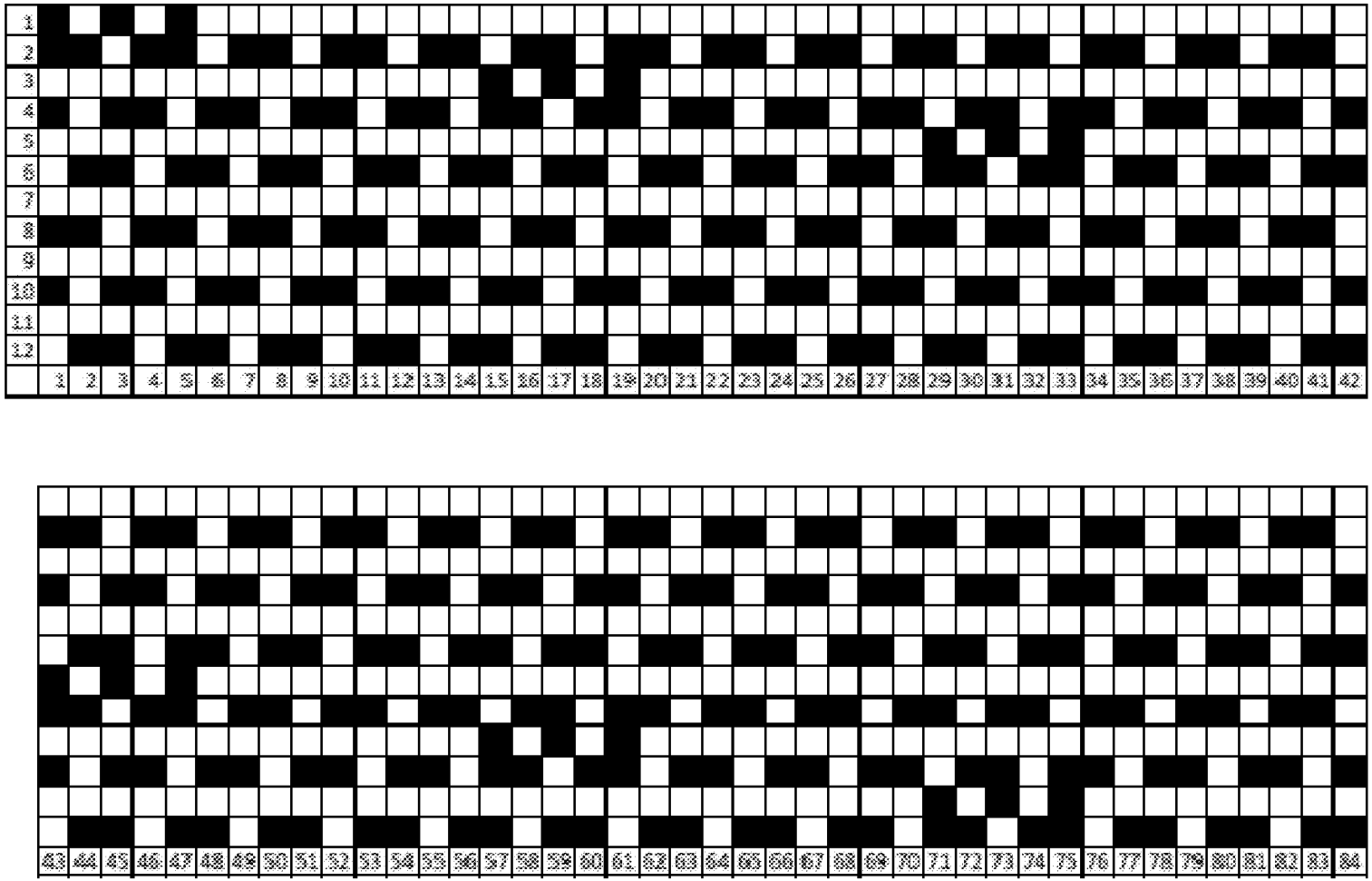
FIG. 9 is another weaving report in the weft direction of a further embodiment of the fabric of the invention.

FIG. 9 is another weaving report in the weft direction of a further embodiment of the fabric of the invention representing weft direction on the front side denim fur design. FIG. 9 weaving report is a 12×84 construction that for reasons of clarity has been represented in two semi-reports.

The construction of FIG. 9 is provided with a weft having a long (length 79) over portion, two short over portions (length 1) and three short-under portions of (length 1) for odd-numbered picks 1, 3, 5, 7, 9 and 11 with a scheme of 79/1/1/1/1/1. For even-numbered picks 2, 4, 6, 8 and 10 the weft is provided with 28 over portions of length 1 and 28 under portions of length 2 with a scheme of 2/1.

In the weaving report of FIG. 9, a twill pattern is repeated. In particular, the construction of FIG. 9 shows warps provided with four short over portions (of length 1), two long under portions (of length 3) and two short under portions (of length 1) with a scheme of 1/1/1/3/1/1/1/3.

As exceptions, in order to create a repeated twill pattern, warps 1, 15, 29, 43, 57 and 71 are provided with one over portion of length 2 and three over portions of length 1, one under portion of length 3, one under portion of length 2 and two under portions of length 2 with a scheme of 2/1/1/3/1/1/1/2

Warps 17, 31, 45, 59 and 73 are provided with one over portion of length 2 and three over portions of length 1, one under portion of length 3, one under portion of length 2 and two under portions of length 1 with a scheme of 2/1/1/3//1/1/1/2 and warps 5, 19, 33, 47, 61 and 75 are provided with one over portion of length 3 and two over portions of length 1, two under portions of length 3 and one under portion of length 1 with a scheme of 3/3/1/1/1/3. Warp 2 has a scheme of 1/3/1/1/1/3/1/1.

Figure 10:
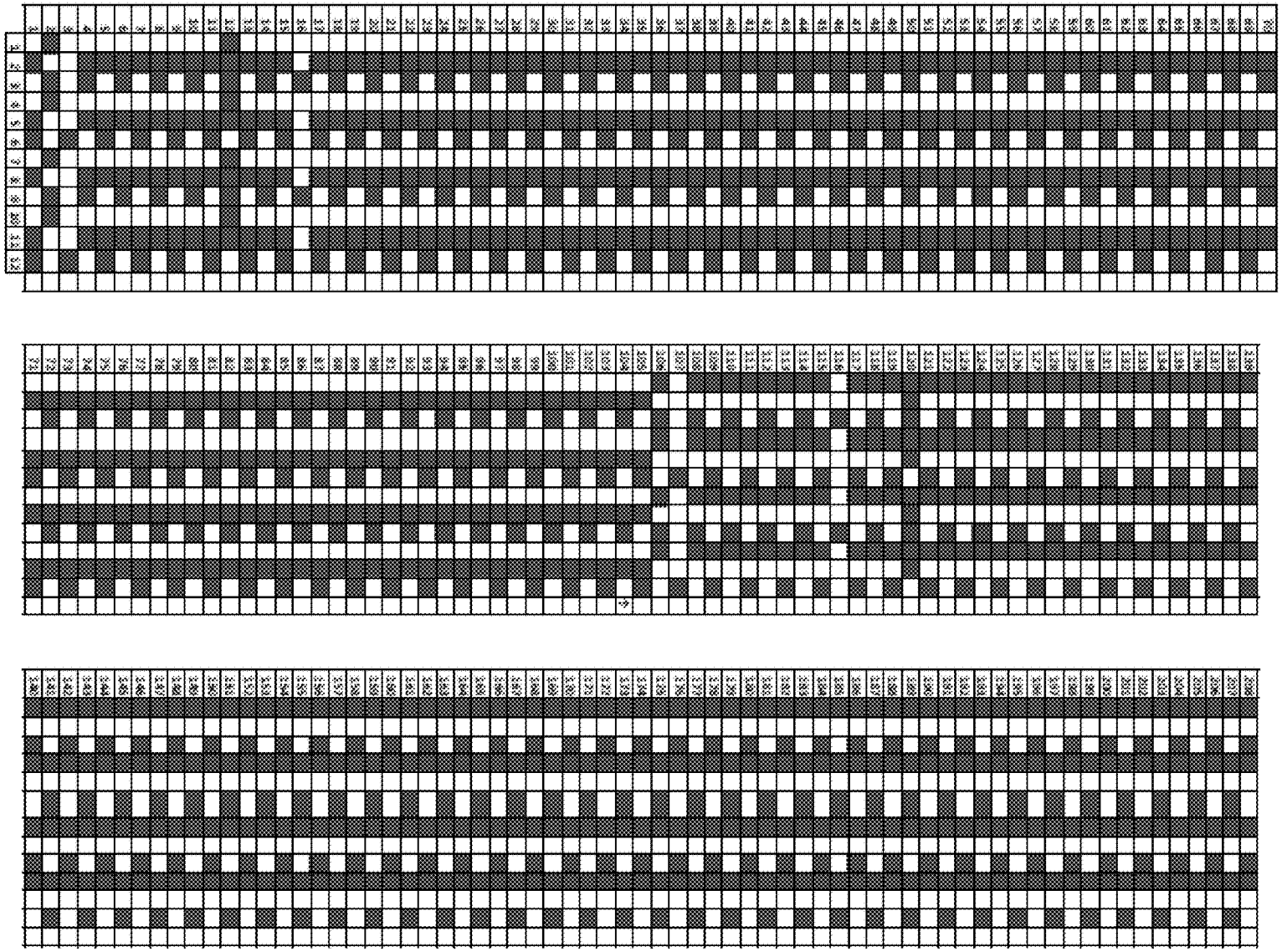
FIG. 10 is still another weaving report of a further embodiment of the fabric of the invention.

FIG. 10 is still another weaving report of a further embodiment of the fabric of the invention. FIG. 10 weaving report is a 12×208 construction that for reasons of clarity has been represented in three portions. This fabric has warps doing over portions and under portions at the same time with different lengths of over/under portions in a same warp.

The construction of FIG. 10 is provided with a warp having a long (length 93) over portion, one shorter over portion of length 8, three short (binding) over portions of length 1, a long (length 92) under portion, one under portions of length 9 and three short under portions of length 1 for picks numbered 1, 4, 7 and 10 with a scheme of 1/1/9/1/93/1/1/8/1/92.

The construction of FIG. 10 is also provided with a warp having a long (length 89) over portion, one over portion of length 12, two short over portions of length 1, a long (length 88) under portion, one under portion of length 14, one under portion of length 2 and one short under portion of length 1 for picks numbered 2, 5, 8 and 11 with a scheme of 1/2/12/1/89/14/1/88.

The construction of FIG. 10 is also provided with a warp yarns, i.e. second warp yarns, having 104 short over portions of length 1, and 104 short under portions of length 1 for picks numbered 3, 6, 9 and 12 with a scheme of 1/1. The warp yarns are arranged to provide alternated second warp yarns and first warp yarns in a ratio 1/2, i.e. there are two first warp yarns for every second warp yarns.

The construction of FIG. 10 is also provided with a weft having two over portions of length 2, two over portions of length 1, two under portions of length 2 and two under portions of length 1 for odd-numbered wefts with a scheme of 1/1/2/2/1/1/2/2. For even-numbered wefts, the construction of FIG. 10 is provided with a weft having two over portions of length 2, two over portions of length 1, two under portions of length 2 and two under portions of length 1 with a scheme of 2/2/1/1/2/2/1/1.

For weft numbered 3, 16, 116, 107, the construction presents one over portion of length 5, one over portion of length 6, and two under portion of length 1, with a scheme of 6/1/5/1. For weft numbered 12 and 120 the construction presents two under portions of length 5, two over portions of length 2 and one over portion of length 1 with a scheme of 5/2/5/1.

Figure 11:
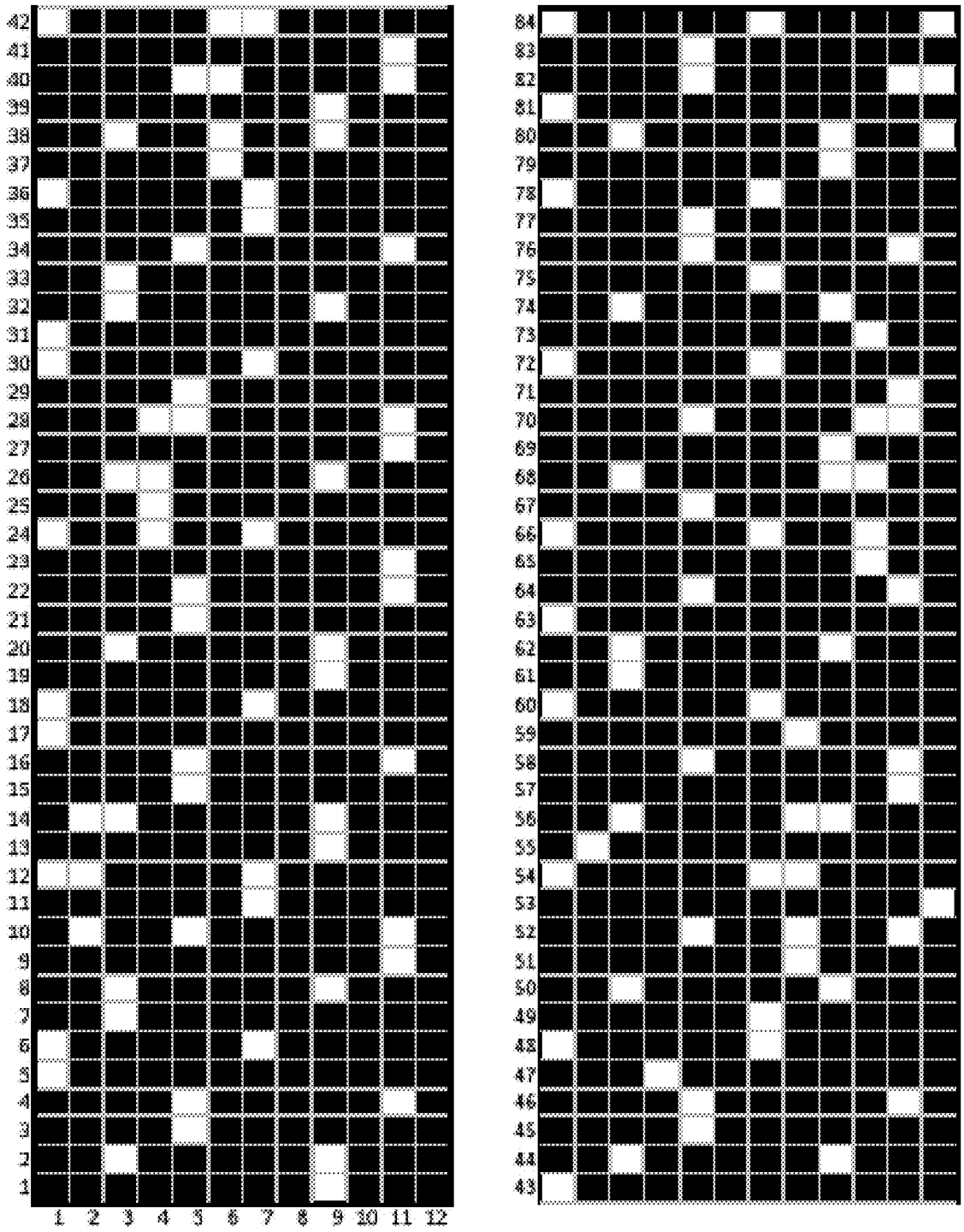
FIG. 11 is another weaving report of a further embodiment of the fabric of the invention.

FIG. 11 is another weaving report of a further embodiment of the fabric of the invention. FIG. 11 weaving report is a 12×84 construction that for reasons of clarity has been represented in two semi-reports. The construction of FIG. 11 is designed in order to have both warp and weft yarns to create over portions.

In particular, pick 1 of the construction of FIG. 11 has eight over portions of length 5, four over portions of length 4, four over portions of length 2, four under portions of length 2 and twelve under portions of length 1 with a scheme of 4/2/5/1/4/2/5/1/5/2/4/1/5/2/4/1/5/1/5/1/2/1/2/1/5/1/5/1/2/1/2/1.

Pick 2 has two long over portions respectively of lengths 38 and 40, two short over portions of length 1 and four short under portions of length 1 with a scheme of 38/1/1/1/1/1/40/1. Pick 3 has eleven over portions of length 5, three over portions of length 4, three under portions of length 2 and eleven under portions of length 1 with a scheme of 5/1/4/2/5/1/5/1/5/1/5/2/4/1/5/1/51/5/1/4/2/5/1/5/1/5/1.

Pick 4 has two long over portions respectively of lengths 60 and 18, one over portion of length 1, one under portion of length 3 and two under portions of length 1 with a scheme of 60/3/1/1/18/1. Pick 5 has seven over portions of length 5, six over portions of length 4, one over portion of length 3, seven under portions of length 2 and eight under portions of length 1 with a scheme of 3/2/5/1/4/2/4/2/5/2/4/1/5/1/4/2/5/1/5/1/5/1/2/1/2/1/5/2/4/2.

Pick 6 has two long over portions of length 36 and length 42, two over portions of length 1, one under portion of length 2 and two under portions of length 1 with a scheme of 36/42/1/2/1/1. Pick 7 has ten over portions of length 5, three over portions of length 4, two over portions of length 2, three under portions of length 2 and twelve under portions of length 1 with a scheme of 5/1/4/2/5/1/5/1/5/1/4/2/5/1/5/2/4/1/5/1/5/1/5/1/2/1/2/1/5/1.

Pick 8 has two over portion of length 25 and length 50), one over portion of length 2, two over portions of length 1, one under portion of length 2 and two under portions of length 1 with a scheme of 75/2/1/1/1/1/2/1. Pick 9 has eight over portions of length 5, six over portions of length 4, six under portions of length 2 and eight under portions of length 1 with a scheme of 2/5/1/4/2/4/2/5/1/5/1/5/2/4/1/5/1/5/1/5/1/5/2/4/1/4/2/4.

Pick 10 has (two over portion of length 11 and length 64), one over portion of length 2, two over portions of length 1, one under portion of length 2 and three under portions of length 1 with a scheme of 75/2/1/1/1/1/2/1. Pick 11 has nine over portions of length 5, four over portions of length 4, one under portion of length 3, six under portions of length 2 and eight under portions of length 1 with a scheme of 5/1/4/2/5/1/5/2/3/2/5/1/5/2/4/1/5/1/4/2/5/1/5/2/4/1/5/1. Pick 12 has two long over portions respectively of lengths 52 and 26, two over portions of length 1 and four under portions of length 1 with a scheme of 52/1/26/1/1/1/1/1.

Figure 12:
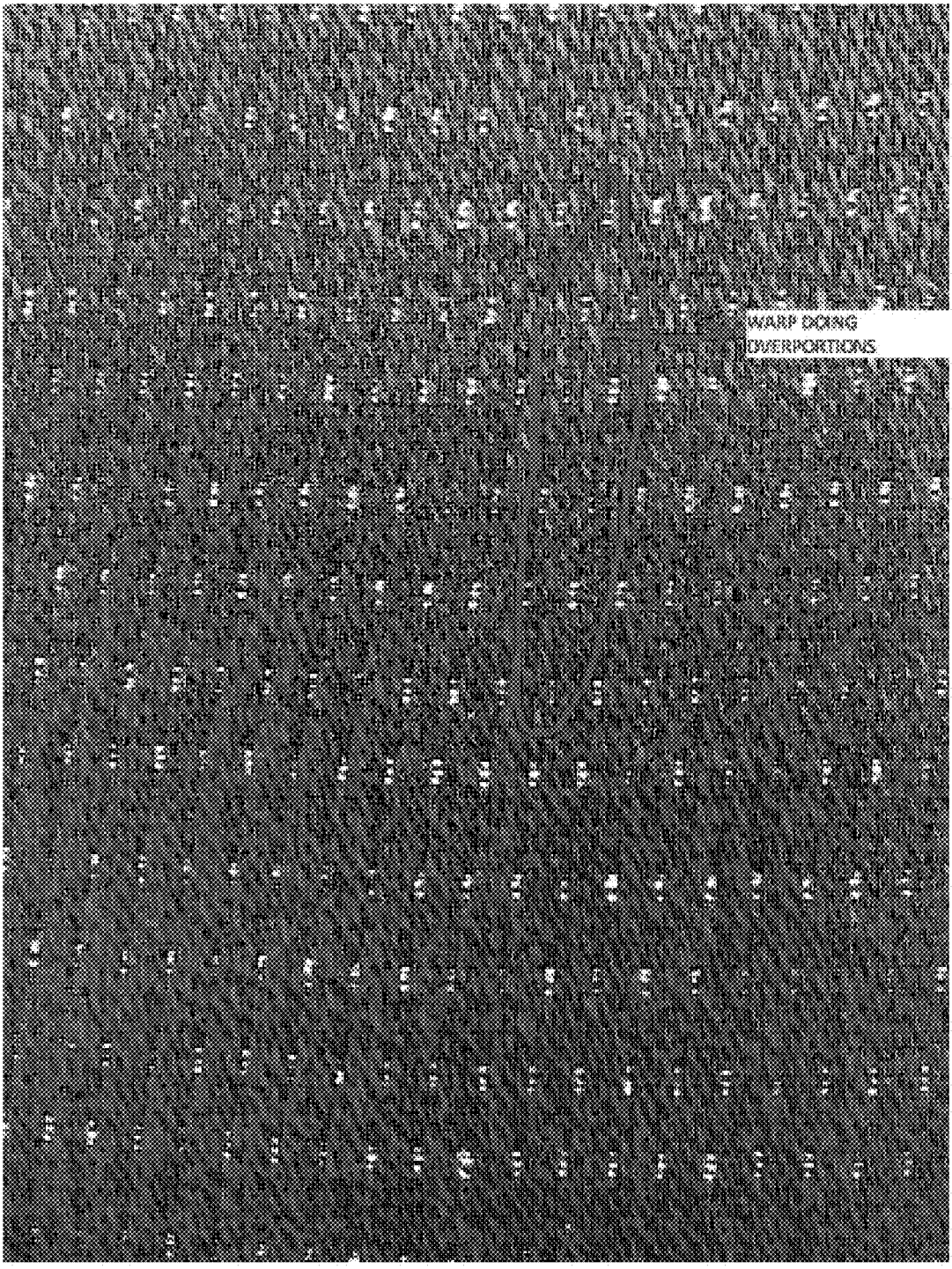
FIG. 12 is a photograph of an embodiment of the fabric of the invention, illustrating the presence of over portions along the warp direction.
Figure 13:
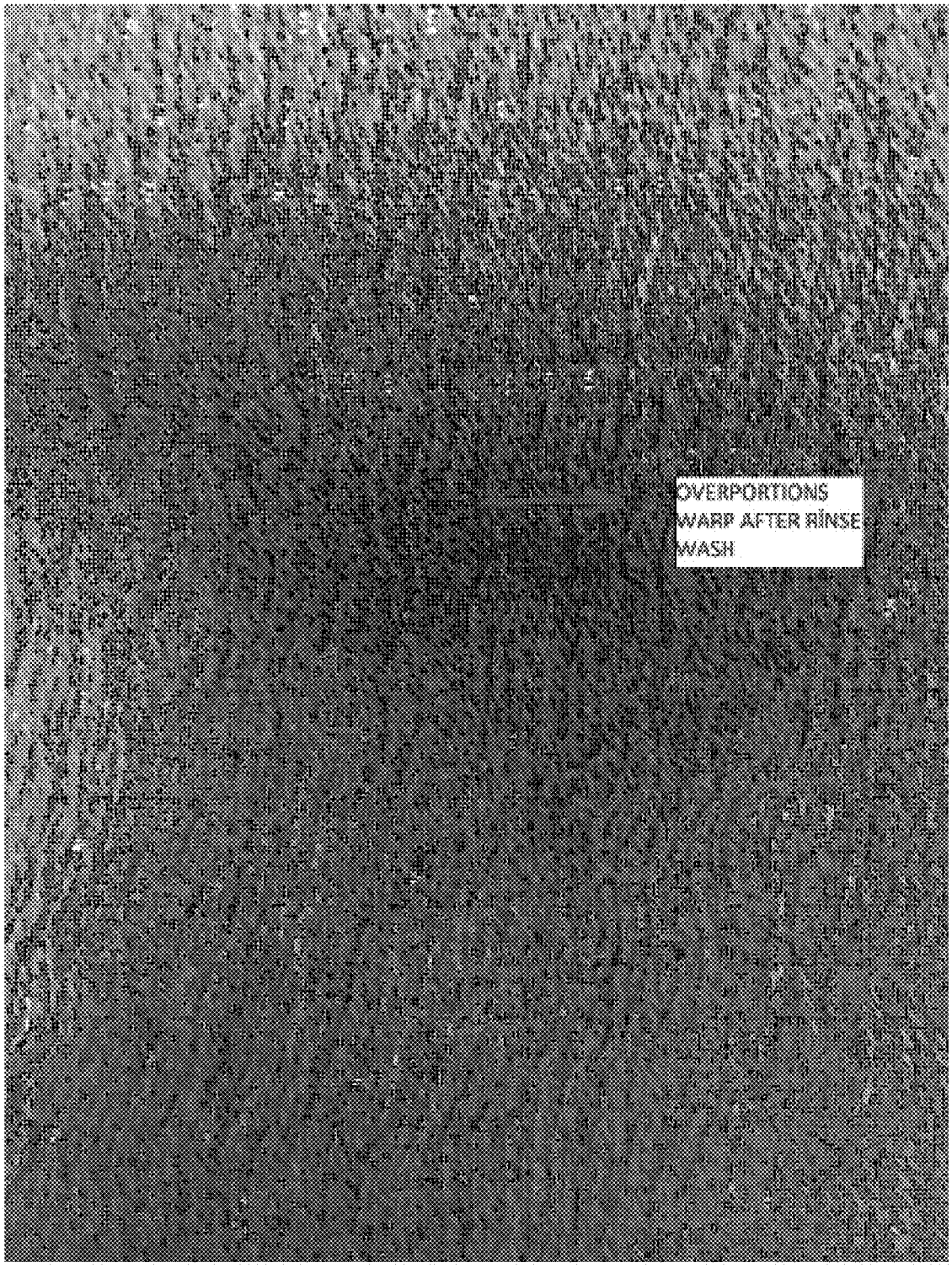
FIG. 13 is photograph an embodiment of the fabric of the invention illustrating the presence of over portions along the warp direction, the fabric being photographed after rinse wash.

FIG. 12 is a photograph of an embodiment of the fabric of the invention on the warp direction and FIG. 13 is photograph of the embodiment of the fabric of the invention of FIG. 12 after rinse wash. In particular, a fabric in a state similar to the fabric of the section of FIG. 1. In fact, after weaving, although the initial lengths of, e.g., first and second warp yarns, w1 and w2, are the same, due to the very different weaving report of said yarns the free-floating of the, e.g., over portions of first warps w1 are longer than the distance (on the fabric) between the start and the end of the said over portions. The difference is increased by the finishing treatment, so as to reach on average 10-50% difference in length to provide a curved and/or undulated aspect of the over portions.

Figure 14:
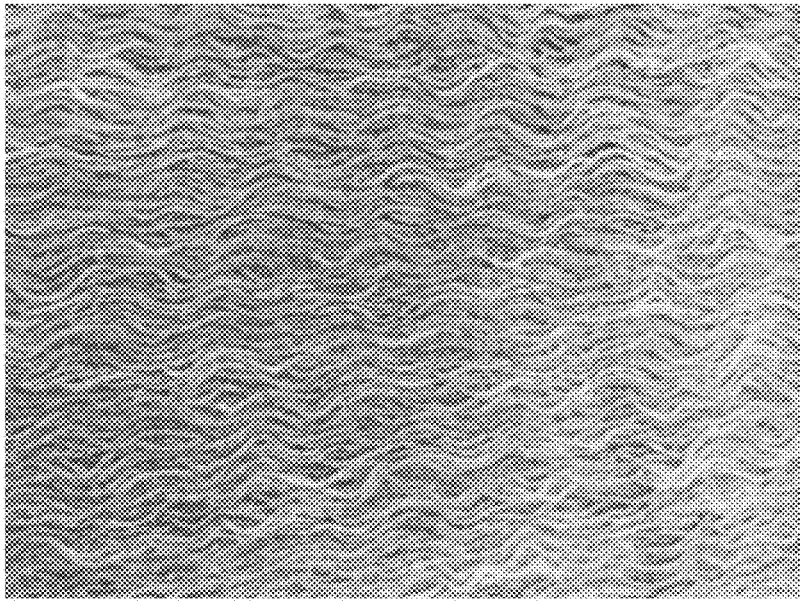
FIG. 14 is a photograph of over portions on the weft direction.
Figure 15:
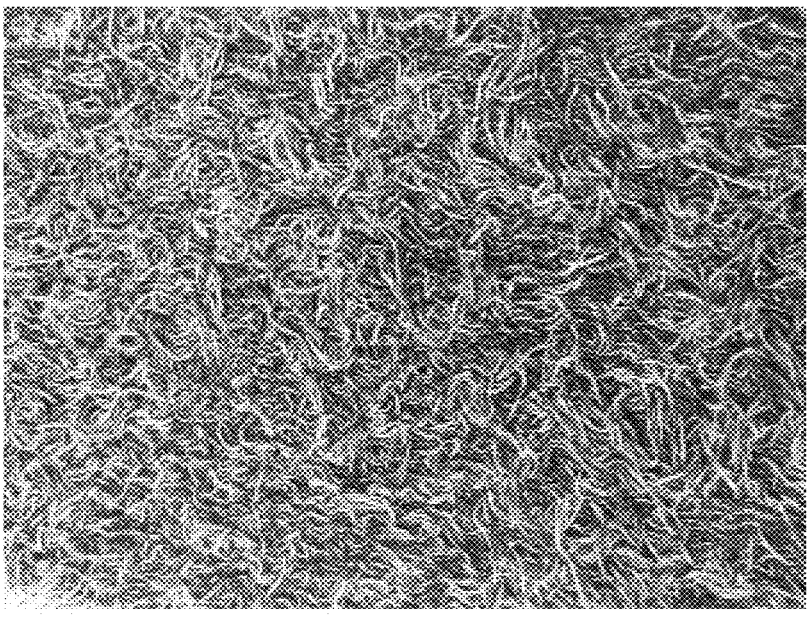
FIG. 15 is photograph of an embodiment of the fabric of the invention after a cutting process.

FIG. 14 is a photograph of another embodiment of the fabric of the invention of FIG. 2 on the weft direction after finishing treatment and FIG. 15 is a photograph of the embodiment of the fabric of the invention after a cutting process. As visible, the cutting, i.e. the process of dividing the over (or under) portions in two parts, results in a furry appearance that may be also increased by additional mechanical treatments.

Figure 16:
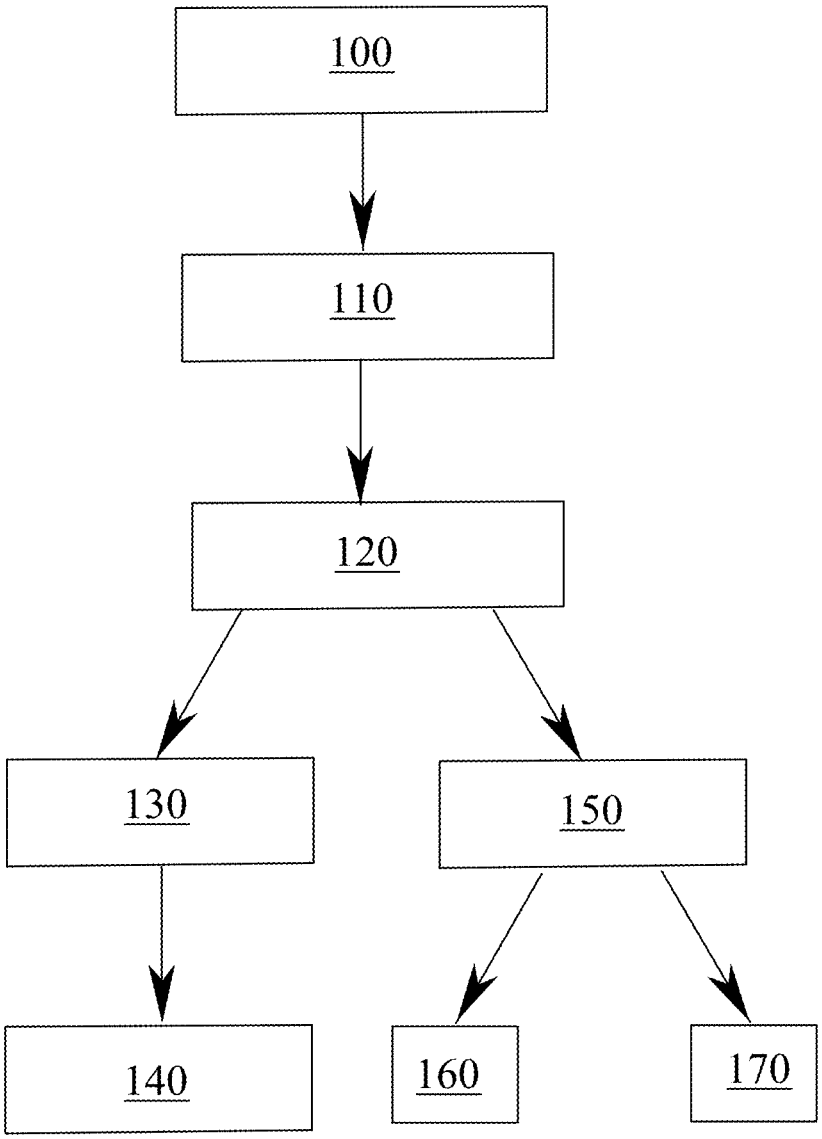
FIG. 16 is a flowchart of a method according to the invention.

FIG. 16 is a flowchart of a method according to the invention. The method starts with the yarns (block 100) that are subjected to a weaving process (block 110), for example using a dobby loom or other similar textile machine. In particular, warp yarns and weft yarns are weaved following a pattern whereby the warp yarns are extending over a number of weft yarns and below a number of weft yarns to provide warp over portions in said front side and warp under portions in said back side and wherein the warp over portions have a length comprised between 8 and 3000 yarns, preferably 8 to 300 yarns. In an embodiment the overportions or underportions of the first warp yarns or of the first weft yarns have a discontinuity, i.e. are divided into two portions, e.g. obtained by laser cutting the first yarns. In this embodiment the two portions of the original over or under portions extend from the fabric at two locations that are spaced by a distance (e.g. measured in number of warps or wefts over which the over/underportion floats before being cut) corresponding to the original length of the over or underportions. In general, in an embodiment having discontinuous (i.e. cut or broken) over or under portions of the first yarns, the said portions may extend (i.e. float), when integral, for a length of 8 to 3000 warp or weft yarns. That is, in one embodiment, two warp portions produced by cutting the warp over portion have a combined length such that would extend past between 8 and 3000 weft yarns. Stated alternatively, the two portions of cut warp yarn extending from the fabric have a combined length such that extends past between 8 and 3000 weft yarns. In other embodiments, the warp over portions or warp under portions have a length such that extends past between 30 to 3000 weft yarns or between 40 to 3000 weft yarns. Stated alternatively, the two portions of cut warp yarn extending from the fabric have a combined length such that extends past between 30 and 3000 weft yarns or between 40 and 3000 weft yarns in the respective embodiments.

In some embodiments, the warp over portions extend over weft yarns so as to have a length comprised between 40 and 100 yarns. In a similar manner, instead of warp over portions, warp under portions can be provided. Warp over portions are preferred to impart the required furry appearance to the final fabric.

In an alternative embodiment, warp yarns and weft yarns are weaved following a pattern whereby the weft yarns are extending over a number of warp yarns and below a number of warp yarns to provide weft over portions in said front side and weft under portions in said back side. The weft over portions have a length comprised between 25 and 3000, preferably 25 to 300 yarns in some embodiments that is, the weft over portions extend past 25 to 3000 warp yarns in some embodiments and extend past 25 to 300 warp yarns in some embodiments. In some embodiments, the weft over portions have a length comprised between 40 and 100 yarns i.e. the weft over portions extend past 40 to 100 warp yarns. Thus, in some embodiments, the weft over portions have a length comprised between 40 and 3000 yarns, i.e., the weft over portions have a length that extends past 40-3000 warp yarns in some embodiments. In a similar manner, instead of weft over portions, weft under portions can be provided to have a length comprised between 40 and 3000 yarns, i.e., the weft under portions have a length that extends past 40-3000 warp yarns. According to one embodiment, the fur look of the fabric is accomplished by the discontinuity formed by cutting the long weft over portions and the long weft under portions that include a length of 40 to 3000 yarns. Once cut to form the discontinuity, the long weft over or under portions of the first yarns, form two weft portions that each extend from the fabric base structure. The cutting of the weft under or over portions that have a length of between 40 and 3000 yarns prior to cutting, thus results in each of the cut weft over or under portions forming two weft portions having a combined length between 40 and 3000 yarns, that is, the two weft portions produced by cutting have a combined length such that would extend past between 40 and 3000 warp yarns. Stated alternatively, the two portions of cut weft yarn extending from the fabric have a combined length such that extends past between 40 and 3000 warp yarns.

The woven fabric is the subjected to a finishing process (block 120). According to an embodiment, then the finished fabric may be subjected to a cutting process (block 130). The cutting process can be performed with any suitable machine with a knife or laser or using any type of chemical application for cutting. In general, the cutting process is used to improve or increase the fur-like look of the final product. Cutting can be made in different ways by using different machines. Laser cutting can be used in particular after a laundry process (block 150). In a further alternative embodiment, after a laundry process (block 150) no cutting is performed (block 170).

After cutting, the fabric may be subjected to a laundry process (block 140). In an alternative embodiment, a laundry process (block 150) is performed before cutting. Then a cutting process is performed (block 160).

In general, the cutting process can be performed in a wide variety of ways, namely using:

1) Any cutting machine known in the art including a knife
2) Laser cutting
3) Ultrasonic fabric cutting machines
4) Any suitable chemical treatment Concerning chemical treatments that can be used for the cutting process as described in the present invention, further details are provided here below.

Burn-out chemical agents can be used. Burn-out agents are strong acids as compounds which split off strong acids and which, in a subsequent heat treatment, destroy the cellulosic fibres. Heat treatment temperature can be 120-200 C.°, preferably 140-180 C°. Suitable examples of burn-out agents are sulphuric acid and amino sulphonic acid, sodium bisulphate, aluminium sulphate, aluminium chloride, magnesium chloride, dibutylnapthalenesulphonic acid and p-toluenesulphonic acid, methanesulphonic acid and sulphonic acids from among arenemonosulphonic or arenedisulphonic acids.

Further suitable burn-out agents are the alkali metal salts of sulphonic acids, particular the sodium or potassium salts in combination with sulphuric acid.

Preferable burn-out agents are sodium bisulphate, aluminium sulphate, p-tallenesulphonic acid, methane-sulphonic acid and alkylnaphthalene sulphonic acids possibly mixed with sulphuric acid.

The fabric is printed with the burn-out agent as customary in the form of a burn-out paste. Print can be full print or designed print.

The amount of burn-out agent to be used in the burn-out pastes increases with the cellulose content of the blend fabric.

Active burn out agents such as, for example, sodium bisulphate or hydrogensulphate may be 20-350 gr/kg, and preferably 50 to 250 gr/kg. These quantities are normally required to obtain acceptable burn-out style fabrics at the amounts of burn-out paste customarily used and to destroy cellulosic fibres.

Active burn-out agents, such as, sulphonic acids require as a rule burn-out agent concentrations in the burn-out pastes of 3 to 160 gr/kg, preferably to 40 to 140 gr/kg. As is usual the burn-out pastes in addition to the burn-out agents also contain water, thickeners and auxiliaries dispersing agent, wetting agent, carrier, glycerol). Examples of suitable thickeners are starch degradation products such as dextrin, non-ionic starch derivatives, such as British gum, types of gum, such as gum arabic, locust bean gum ether thickener and guar derivatives.

While at least one exemplary embodiment was disclosed in the foregoing summary and detailed description, it should be appreciated that a vast number of variations exist. The exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. A garment comprising a woven denim fabric that imitates natural fur, the denim fabric having warp yarns and weft yarns, said denim fabric having a front side and a back side, said warp yarns and weft yarns being woven together in a weaving pattern, the weaving pattern comprising alternated first and second warp yarns and alternated first and second weft yarns, the weaving pattern of at least said second warp yarns and second weft yarns providing a base structure of the denim fabric, whereby said first warp yarns extend over said weft yarns in said front or back side of the denim fabric to provide warp over portions in said front side and/or warp under portions in said back side and wherein at least some of the warp over portions and/or warp under portions extend over a length of between 30 and 3000 weft yarns, wherein only at least part of said over portions or under portions of said first warp yarns include a discontinuity, wherein each said discontinuity comprises two portions of yarn extending from said denim fabric and having a combined length such that extends past between 30 and 3000 weft yarns; and wherein said second warp yarns extend over only 1 to 4 yarns.

2. The garment of claim 1, further comprising weft over portions and weft under portions, wherein at least some of the weft over portions and/or weft under portions extend over a length comprised between 40 and 400 warp yarns.

3. The garment of claim 1, wherein a first warp over portion of said warp over portions of said first warp yarns, or a first weft over portion and/or a first warp under portion of said warp under portions of said first warp yarns or a first weft under portion extend over a length in the range of 45 to 400 weft or warp yarns.

4. The garment of claim 1, wherein said warp over portions and/or said warp under portions have a count in the range from Ne 0.5 to Ne 40.

5. The garment of claim 4, wherein said second warp yarns have a count in the range from Ne 5 to Ne 100.

6. The garment according to claim 1, wherein at least part of said first warp yarns or first weft yarns are dyed or ring dyed.

7. The garment of claim 1, wherein each said discontinuity is on the front side of said garment.

8. The garment of claim 1 further comprising weft over portions-and weft under portions, wherein said first warp yarns or weft yarns forming said over portions or under portions have a count in the range from Ne 2 to Ne 15.

9. The garment of claim 1, wherein the alternated first and second warp yarns are alternated such that a ratio of a number of first yarns:a number of second yarns is 3:1.

10. The garment of claim 1, wherein the alternated first and second warp yarns are alternated such that a ratio of a number of first yarns:a number of second yarns is 1:3.

11. The garment of claim 1, wherein at least some of the warp and/or weft yarns are elastic.

12. The garment of claim 1, wherein some of the warp over portions have a length ranging from 18 mm to 1400 mm.

13. The garment of claim 12, further comprising weft over or under portions having a length in the range from 8 mm to 110 mm.

14. The garment of claim 1, wherein the denim comprises said weft and warp yarns in a twill design, said warp over portions and/or said warp under portions have a count in the range from Ne 0.5 to Ne 40, and said second warp yarns have a count in the range from Ne 5 to Ne 100.

15. The garment of claim 1, wherein each said discontinuity comprises two portions of yarn extending from said denim fabric and having a combined length such that extends past between 30 and 450 weft yarns.

16. A method of preparing a garment with a fabric that imitates natural fur, said method comprising:

weaving warp yarns or weft yarns following a pattern providing alternated first and second warp yarns and alternated first and second weft yarns, the weaving pattern of at least said second warp and weft yarns providing a base structure of the fabric, whereby at least one of said first warp yarns and said first weft yarns extends over a number of weft or warp yarns and/or below a number of weft or warp yarns to provide warp or weft over portions in a front side and/or warp or weft under portions in a back side and wherein only at least some of the warp over portions and/or warp under portions extend over a length of between 40 and 3000 weft yarns and at least some of the weft over portions and/or weft under portions extend over a length of between 40 and 400 warp yarns;

cutting at least some of said warp over portions or said warp under portions to produce a plurality of discontinuities, each said discontinuity associated with a cut one of said warp over portions or said warp under portions and comprising two portions of cut yarn extending from said fabric and having a combined length such that extends past between 40 and 3000 weft yarns; and wherein said second warp yarns extend over only 1 to 4 yarns.

17. The method of claim 16, wherein the warp or weft over portions and/or the warp or weft under portions of said first yarns extend over a length comprised between 45 to 400 weft or warp yarns.

18. The method of claim 16, wherein said cutting comprises cutting using ultrasonic fabric cutting machines or chemical treatment with burn-out agents.

19. The method of claim 10, wherein some of the warp or weft over portions and/or the warp or weft under portions of said first yarns are whole.

20. The method of claim 16, wherein said cutting comprises cutting with an ultrasonic fabric cutting machine.

21. The method of claim 16, wherein said cutting comprises using a chemical treatment with burn-out agents, said burn-out agents comprising sodium bisulphate or aluminium sulphate.

22. The method of claim 16, further comprising carrying out a laundry process prior to said cutting.

23. A garment comprising a woven fabric that imitates natural fur, the fabric having warp yarns and weft yarns, said fabric having a front side and a back side, said warp yarns and weft yarns being woven together in a weaving pattern, the weaving pattern comprising alternated first and second warp yarns and alternated first and second weft yarns, the weaving pattern of at least said second warp yarns and second weft yarns providing a base structure of the fabric, whereby said first warp yarns extend over a number of said weft yarns at least on said front side of the fabric to provide warp over portions in said front side and wherein at least some of the warp over portions extend over a length of between 40 and 3000 weft yarns, wherein only at least some of said warp over portions of said first warp yarns include a discontinuity, wherein each of said over portions that include a discontinuity are formed of two portions of yarn extending from said fabric and having a combined length such that extends past between 40 and 3000 weft yarns; and wherein said second warp yarns extend over only 1 to 4 yarns.

24. The garment of claim 23, wherein the alternated first and second warp yarns are alternated in such that a ratio of a number of first yarns:a number of second yarns is 1:3.

25. The garment of claim 23, wherein some of the warp over portions have a length ranging from 18 mm to 1400 mm.

26. The garment of claim 23, wherein at least some of the warp and/or weft yarns are elastic.

27. The garment of claim 23, wherein said second warp yarns have a count in the range from Ne 5 to Ne 100 and said warp over portions and/or said warp under portions have a count in the range from Ne 0.5 to Ne 40.

* * * * *